US008011841B2

(12) United States Patent
Ihara et al.

(10) Patent No.: US 8,011,841 B2
(45) Date of Patent: Sep. 6, 2011

(54) RE-TRANSFER PRINTING MACHINE AND METHOD THEREOF

(75) Inventors: Keiji Ihara, Yokohama (JP); Yoshihiro Nishiyama, Yokohama (JP); Toshinori Takahashi, Yokohama (JP)

(73) Assignee: Victor Company of Japan, Limited, Yokohama-shi, Kanagawa-ken (JP)

( * ) Notice: Subject to any disclaimer, the term of this patent is extended or adjusted under 35 U.S.C. 154(b) by 474 days.

(21) Appl. No.: 12/232,502

(22) Filed: Sep. 18, 2008

(65) Prior Publication Data

US 2009/0074948 A1 Mar. 19, 2009

(30) Foreign Application Priority Data

Sep. 19, 2007 (JP) ..... 2007-241998

(51) Int. Cl.
*B41J 29/38* (2006.01)

(52) U.S. Cl. ..... 400/120.03; 400/76; 400/240.4; 400/521

(58) Field of Classification Search ..... 400/76, 400/240, 240.4, 521, 120.03; 101/34, 33; 347/213, 176
See application file for complete search history.

(56) References Cited

U.S. PATENT DOCUMENTS 6,263,796 B1 * 7/2001 Jordan ..... 101/486
6,642,948 B2 * 11/2003 Miki ..... 347/213
2004/0192549 A1 * 9/2004 Odamura et al. ..... 503/201

FOREIGN PATENT DOCUMENTS

JP 05-052069 3/1993
JP 11-321166 11/1999

* cited by examiner

*Primary Examiner* — Judy Nguyen
*Assistant Examiner* — Jennifer Simmons
(74) *Attorney, Agent, or Firm* — The Nath Law Group; Jerald L. Meyer; Jiaxiao Zhang

(57) ABSTRACT

A re-transfer printing machine 60 uses an ink film 33 having a sublimation-ink area of sublimation inks Y, M, C and an invisible-ink area of an invisible ink UVS and an intermediate-transfer film 11 having a protecting layer 11*c* and an ink receptor layer 11*d* enabling the sublimation inks and the invisible ink to be received. The machine includes an overlap detecting part 76-5 for detecting whether a print image contains an overlapping between a sublimation-ink image 18 and an invisible-ink image 20 and a controller 6 for controlling a transfer operation corresponding to detection by the overlap detecting part. If the overlap detecting part detects that the print image contains the overlapping, the controller allows the machine to transfer the sublimation-ink and invisible-ink images to different areas in the receptor layer. If not, the controller allows the machine to transfer the sublimation-ink and invisible-ink images to an identical area 212 in the receptor layer.

13 Claims, 12 Drawing Sheets

RE-TRANSFER PRINTING MACHINE AND METHOD THEREOF

BACKGROUND OF THE INVENTION

1. Field of the Invention

The present invention relates to a re-transfer printing machine and a re-transfer printing method. Particularly, the present invention relates to a technique which is superior in economical efficiency while enhancing the security of information printed on an objected to be printed.

2. Description of Related Art

Hitherto, a technique of preventing interpolation and counterfeit of an objected to be printed, such as card, thereby to enhance its security has been variously contemplated and made practicable.

It is preferable to apply such a technique on an object to be printed, especially, a variety of cards (in detail, credit card, ID card, certification card, etc).

For cards as personal identifiers, it is often the case that an owner's facial portrait is printed on the card. In the situation, there is an increasing movement of using sublimation ink(s) suitable for high-grade photographic printing in addition to fusible ink suitable for printing characters.

In the technology of enhancing the security of a card, there is known a technique of using invisible ink thereby to make printed information (e.g. photo or data) invisible normally. With specific light within a specific wavelength band (e.g. ultraviolet light), the invisible ink becomes fluorescent to be visible although it becomes invisible under visible light normally. For instance, Japanese Patent Laid-Open Publication No. 5-52069 discloses such a technique of printing a certificate code on a card with the use of invisible ink.

In addition, a technique of manufacturing a card with the use of both sublimation ink and invisible ink is disclosed in Japanese Patent Laid-Open Publication No. 11-321166. In the above publication, there is described an identification (ID) card whose security can be enhanced as a result of preventing the card from being tampered or counterfeiting. This identification card is provided with a facial-portrait area on which a facial portrait (image) is printed by using the sublimation ink. On the facial-portrait area, additionally, owner's inherent information is printed by using fluorescent ink that becomes fluorescent to be visible due to irradiation of ultraviolet light.

Regarding a method of manufacturing this card, Japanese Patent Laid-Open Publication No. 11-321166 further discloses the use of a sublimation transfer ribbon. The sublimation transfer ribbon has respective sublimation-dye layers in yellow (Y), magenta (M), cyan (C) and black (B) arranged on a ribbon base, in this order. The sublimation transfer ribbon further includes fluorescent ink and a protecting layer arranged on the ribbon base so as to follow these sublimation-dye layers.

SUMMARY OF THE INVENTION

Meanwhile, in general, the sublimation ink has greater room for improvement in its light stability than the fusible ink. That is, as the sublimation ink has a tendency to be discolored by irradiation of light, it is desired to restore the color of the sublimation ink.

In the card disclosed in Japanese Patent Laid-Open Publication No. 11-321166, however, whenever ultraviolet light is irradiated on the card in confirming information printed with the invisible ink, the sublimation ink is directly subjected to fluorescence of the invisible ink.

For this reason, there is fear that color-fading is accelerated to cause the printed image (e.g. facial portrait) of the sublimation inks to deteriorate, shortening an available period of the card.

As the print layout is unrestricted on the object to be printed, such as a card, the printing machine is required to enable a printing of information even against an object having such a layout that the invisible ink is not overlaid on the sublimation ink.

That is, if a printing machine is specialized for only printing against the layout where the sublimation ink and the invisible ink are laid to overlap each other, the printing machine would be not only inferior in usability but also raising the manufacturing cost. For such a reason, the printing machine and method are required to enable an appropriate printing without limitation from the print layout and also an exhibition of high security.

In addition, it is desirable that information printed while requiring a high security is responsible to traceability appropriately.

For instance, if the information about a printing machine (e.g. manufacturing information, repairing history, change record, etc.) could be specified by information on the object, it would be advantageous extremely.

Under such a circumstance, an object of the present invention is to provide a re-transfer printing machine that is capable of printing using invisible ink with high security with no limitation to the print layout on an object to be printed, that allows the printed object to be used in the long term as a result of the restraint of discolored sublimation ink in spite of the print layout where the sublimation ink and the invisible ink are arranged to overlap each other and that is excellent in the traceability about printing on such a printed matter. Further, another object of the present invention is to provide a re-transfer printing method using such a re-transfer printing machine.

In order to achieve the former object, there is provided a re-transfer printing machine comprising: an ink film having a sublimation-ink area of at least one sublimation ink and an invisible-ink area of an invisible ink; an intermediate-transfer film having a protecting layer and an ink receptor layer laminated on the protecting layer to enable the sublimation ink and the invisible ink to be received therein; a transfer mechanism for transferring the sublimation ink and the invisible ink to a plurality of areas segmentalized in the ink receptor layer thereby to form a sublimation-ink image of the sublimation ink and an invisible-ink image of the invisible ink in the ink receptor layer, based on a print image for an object to be printed; a re-transfer mechanism for re-transferring the sublimation-ink image and the invisible-ink image to the object thereby to form the print image thereon; a controller for controlling respective operations of the transfer mechanism and the re-transfer mechanism; and an overlap detecting unit connected to the controller to detect whether the print image for the object contains an overlapping between the sublimation-ink image and the invisible-ink image or not, wherein when the overlap detecting unit detects that the print image contains the overlapping, the controller allows the transfer mechanism to transfer the sublimation-ink image and the invisible-ink image to different areas in the receptor layer, the different areas corresponding to the object respectively, and when the overlap detecting unit detects that the print image does not contain the overlapping, the controller allows the transfer mechanism to transfer the sublimation-ink image and the invisible-ink image to an identical area in the receptor layer, the identical area corresponding to the object.

Still further, there is also provided a re-transfer printing method using an ink film having a sublimation-ink area of at least one sublimation ink and an invisible-ink area of an invisible ink and an intermediate-transfer film having a protecting layer and an ink receptor layer laminated on the protecting layer to enable the sublimation ink and the invisible ink to be received therein, the method comprising the steps of: detecting whether a print image for an object to be printed contains an overlapping between a sublimation-ink image printed in the sublimation ink and an invisible-ink image printed in the invisible ink or not; transferring the sublimation ink and the invisible ink to a plurality of areas segmentalized in the ink receptor layer thereby to form a sublimation-ink image and the invisible-ink image of the invisible ink in the ink receptor layer, based on the print image for the object to be printed; and re-transferring the sublimation-ink image and the invisible-ink image to the object thereby to form the print image thereon, wherein when it is detected at the detecting step that the print image contains the overlapping, the transferring step includes a step of transferring the sublimation-ink image and the invisible-ink image to different areas in the receptor layer in a longitudinal direction thereof, the different areas corresponding to the object respectively, and when it is detected at the detecting step that the print image does not contain the overlapping, the transferring step includes a step of transferring the sublimation-ink image and the invisible-ink image to an identical area in the receptor layer, the identical area corresponding to the object.

DETAILED DESCRIPTION OF THE PREFERRED EMBODIMENTS

Preferred embodiments of the present invention will be described below, with reference to FIGS. 1A to 16.

According to the embodiment, a re-transfer printing machine is adapted so as to use an ink film where ink layers of sublimation ink etc. are formed in planes sequentially. Using this ink film, the machine transfers an image to an intermediate-transfer film having an ink receptor layer and successively re-transfers such a transferred image to a card base (card substrate) as an object to be printed thereby to produce a card. This printing method is called to as "re-transfer printing method".

Figure 1A:
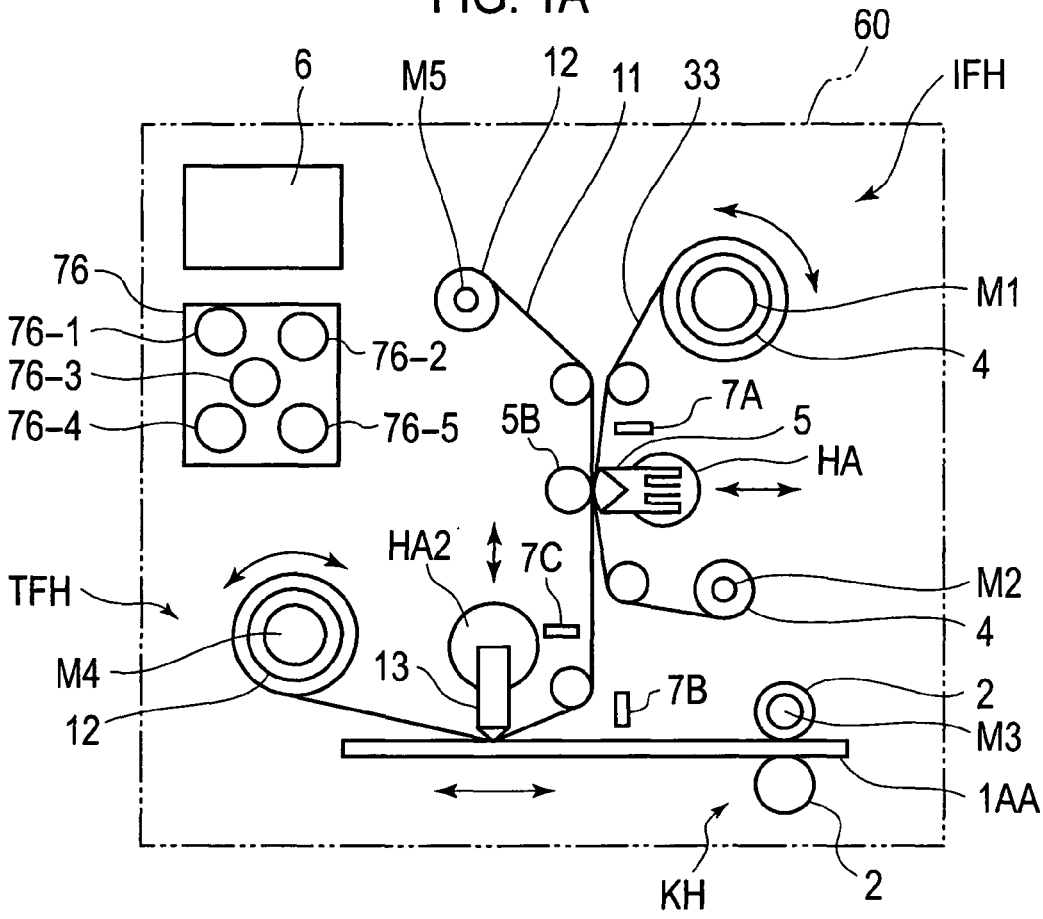
FIG. 1A is a schematic structural view explaining a re-transfer printing machine in accordance with an embodiment of the present invention.
Figure 1B:
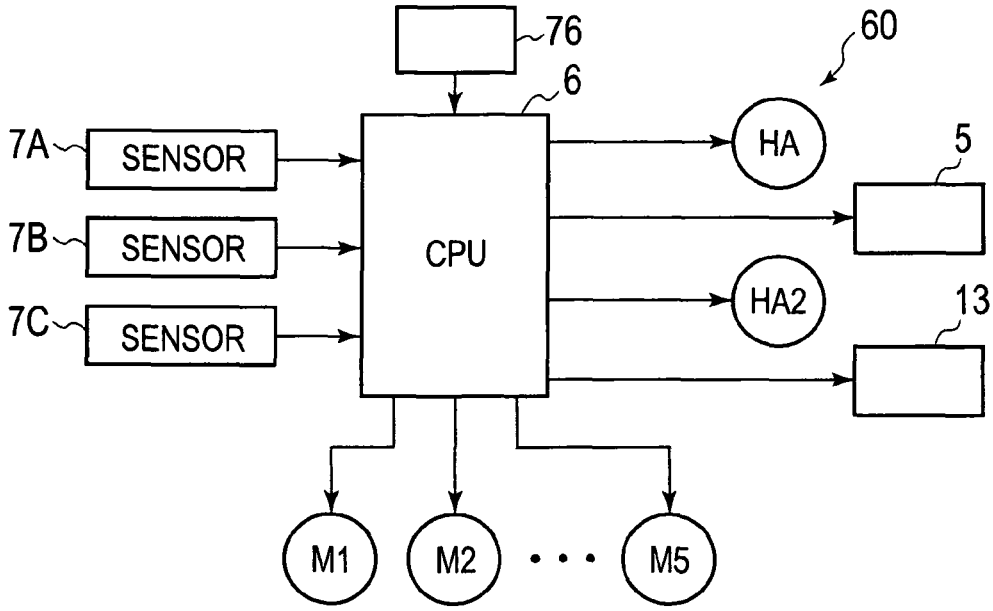
FIG. 1B is a block diagram of the re-transfer printing machine.

The re-transfer printing machine of the invention is embodied by a card manufacturing apparatus 60. As shown in FIGS. 1A and 1B, the apparatus 60 comprises a card feeder KH having a motor M3 as a feeder driving source for the card base 1AA and a pair of pinch rollers 2 connected to a motor M3 to feed the card base 1AA while pinching it therebetween, a sensor 7B for detecting a feeding position of the card base 1AA, an ink-film feeder IFH having a pair of reels 4 for winding and rewinding a later-mentioned ink film 33 and motors M1, M2 for rotating the reels 4 respectively, a sensor 7A for detecting later-mentioned position marks PM11 to PM14 in non-contact manner, the position marks being arranged on the ink film 33 in order to specify the positions of respective ink layers, a thermal head 5 for heating up the ink film 33 thereby to sublimate sublimation ink or fuse fusible ink, a head actuator HA for moving the thermal head 5 with respect to a roller 5B to left and right (in FIG. 1A) so that the ink film 33 is pressed on an intermediate-transfer film 11, a controller 6 for controlling the operation of the whole apparatus 60 and a data processor 76 for processing data to be printed on the card base 1AA.

The card manufacturing apparatus 60 further includes an intermediate-transfer film feeder TFH having a pair of reels 12 for winding and rewinding the intermediate-transfer film 11 and motors M4, M5 for rotating the reels 12 respectively, a sensor 7C for detecting position marks on the film 11 in non-contact manner, the position marks being arranged on the film 11 to specify its feeding positions, a thermal head 13 for heating up the film 11 thereby to sublimate sublimation ink or fuse fusible ink and a head actuator HA2 for moving the thermal head 13 vertically (in FIG. 1A) so that the film 11 is pressed on the card base 1AA.

Figure 2:
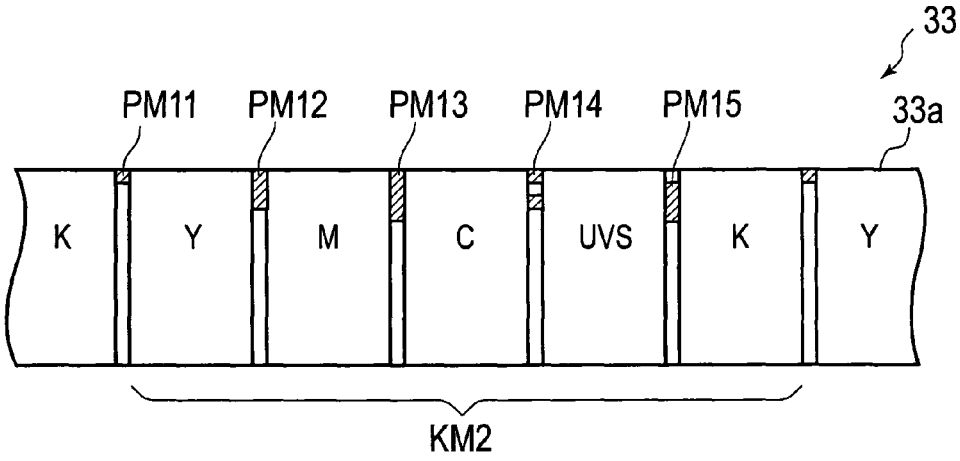
FIG. 2 is a plan view explaining an ink film used in the re-transfer printing machine in the embodiment of the present invention.

As shown in FIG. 2, the ink film 33 has a strip-shaped base sheet 33*a*, sublimation-ink layers Y, M and C, an ultraviolet-emitting-ink layer UVS and a fusible-ink layer K, which are formed on a surface of the base sheet 33*a*, in sequence.

Hereinafter, these layers of the ink film 33 may be referred to as "sublimation-ink area", "sublimation ultraviolet-emitting-ink (invisible-ink) area" and "fusible-ink area", respectively.

In detail, plural groups of layers (KM2) are formed in the longitudinal direction of the ink film 3 successively. Each group of layers (KM2) comprises, in the longitudinal direction of the ink film 33, the above sublimation-ink layers Y, M and C colored in yellow (Y), magenta (M) and cyan (C), the sublimation ultraviolet-emitting-ink layer UVS and the fusible-ink layer K colored in black, in this order. Defining these layer elements as one group, multiple groups are formed on the ink film 33 repeatedly.

In order to allow respective positions of these layers to be detected by sensor 7A, the position marks PM11 to PM15 are formed so as to correspond to respective ink layers.

Figure 3:
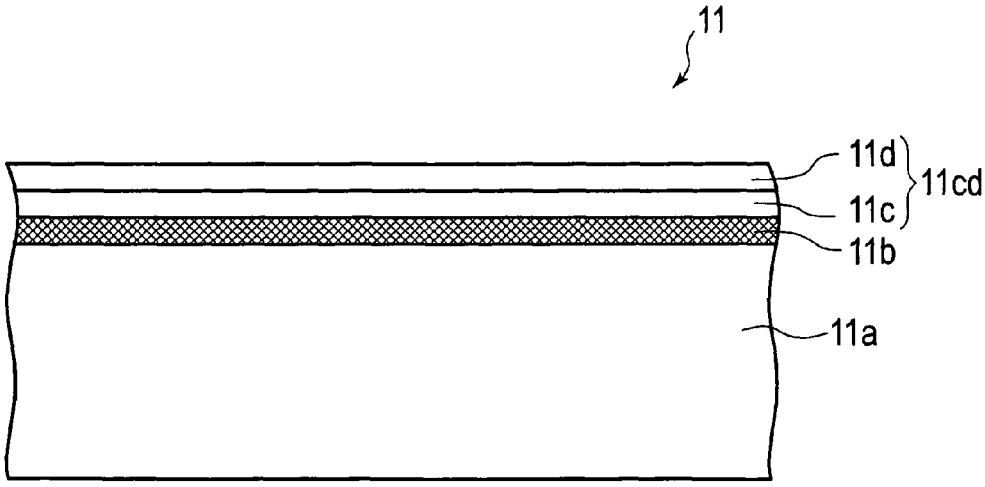
FIG. 3 is a sectional view explaining a intermediate-transfer film used in the re-transfer printing machine in the embodiment of the present invention.

As shown in FIG. 3, the intermediate-transfer film 11 comprises a strip-shaped film base 11*a* and a release layer 11*b*, a protecting layer 11*c* and an ink receptor layer 11*d*, which are laminated on a surface of film base 11*a*, in this order.

In these layers, the protecting layer 11*c* and the ink receptor layer 11*d* constitute a transfer layer 11*cd*. The release layer 11*b* is provided to facilitate a separation of the transfer layer 11*cd*.

The protecting layer 11*c* is made from resinous material, for example, polyurethane resin, acrylate resin, polyethylene resin and so on.

In the above-mentioned constitution, the controller 6 carries out a cueing operation of the intermediate-transfer film 11 (i.e. cueing of a film's unused area on which an ink is to be transferred) and another cueing operation of a first sublimation-ink layer in a specific color (e.g. yellow) to be firstly transferred about an image to be transferred onto the above unused area, based on output signals from the sensors 7A, 7C. Thus, the controller 6 drives the ink-film feeder IFH and the intermediate-transfer film feeder TFH so that respective cueing positions of the films 11, 33 coincide with the thermal head 5.

In association with the positioning of the films 11, 33, the controller 6 drives the head actuator HA thereby to feed the films 11, 33 while pinching them between the thermal head 5 and the roller 5B. Simultaneously, the controller 6 controls to heat up the thermal head 5 for sublimating inks so that a designated transfer image is transferred onto the intermediate-transfer film 11.

Then, the sublimation ink is transferred to the intermediate-transfer film 11 since the ink receptor layer 11*d* therein retains the sublimation ink.

The data processor 76 drafts print data to be printed in the invisible ink by means of a user's manipulation for data input and further detects the possibility (i.e. presence or absence) of an overlapping of areas printed in respective inks on the ground of a print layout for the object to be printed. Corresponding to the detection result, the data processor 76 establishes a transfer mode for the intermediate-transfer film 11 so as to enable it to be utilized effectively.

This transfer mode is also applicable to the re-transfer operation. Now, the transfer mode is classified broadly into two modes A and B. Further, the mode A is classified into two modes A1 and A2, while the mode B is classified into two modes B1 and B2. These modes will be described in detail, with respect to each mode.

The controller 6 carries out transfer and re-transfer operations based on the transfer mode established in the data processing part 76.

(Mode A1)

Figure 4:
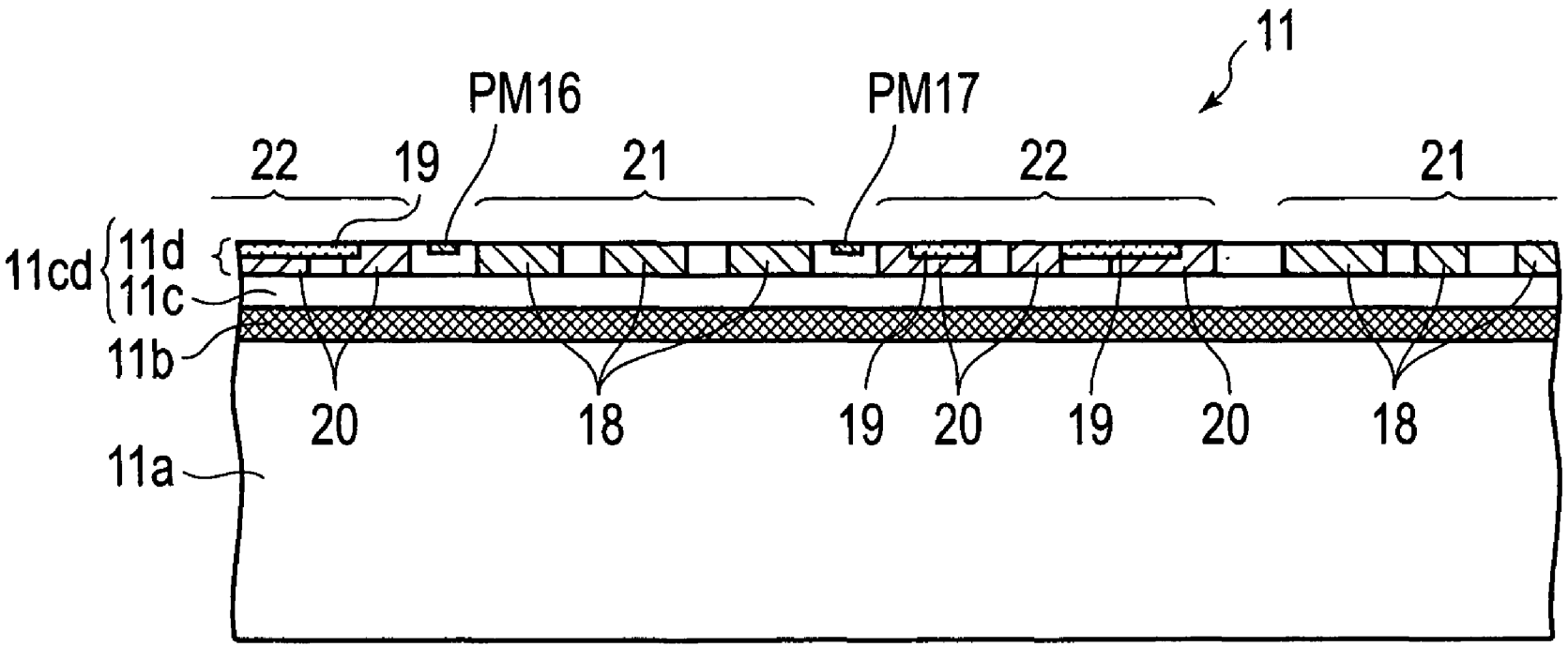
FIG. 4 is a sectional view explaining a transfer process in A1 mode in the re-transfer printing machine in the embodiment of the present invention.

FIG. 4 is a schematic sectional view of the intermediate-transfer film 11 after the transfer operation performed by the controller 6 based on the mode A1 established by the data processor 76.

In the transfer operation for the intermediate-transfer film 11, the sublimation inks in respective colors Y, M and C are transferred to a first transfer area 21, in piles.

While, in a second transfer area 22 situated next to the first transfer area 21 through a predetermined interval, respective inks of the ultraviolet-emitting-ink layer UVS and the fusible-ink layer K are transferred in piles.

That is, by repeating the cueing of the first transfer area 21 and the cueing of respective colors in the ink film 33, respective sublimation-inks in colors Y, M and C are transferred into the ink receptor layer 11*d*. As a result, a sublimation-ink image 18 is formed in the ink receptor layer 11*d*.

This image can be printed in full colors with remarkably-high grade and therefore, it is better suited for facial portrait.

For the ink receptor layer 11*d* in the second transfer area 22, ink of the ultraviolet-emitting-ink layer UVS is firstly transferred to form an invisible-ink image 20. In succession, ink of the fusible-ink layer K is transferred so as to overlap the image 20, forming a fusible-ink image 19.

Thus, the later-formed fusible-ink image 19 is positioned on the front side of the ink receptor layer 11*d*.

Hereinafter, contingently, the ink receptor layers 11*d* in the first and second transfer areas 21, 22 may be specified with reference codes 11*d*1, 11*d*2, respectively. Similarly, the protecting layers 11*c* in the first and second transfer areas 21, 22 may be specified with reference codes 11*c*1, 11*c*2, respectively.

The first and second transfer areas 21, 22 for the ink images 18 to 20 are previously established in the intermediate-transfer film 11. That is, the areas 21, 22 comprise two areas of a plurality of areas segmentalized in the ink receptor layer 11*d* in the longitudinal direction of the film 11. Between the first transfer area 21 and the second transfer area 22, there are position marks PM16, PM17 enabling these areas 21, 22 to be specified. These position marks are detected by the sensor 7B, while the controller 6 judges the positioning of the intermediate-transfer film 11, based on the detection signals from the sensor 7B.

The ink images 18 to 20 transferred to the intermediate-transfer film 11 are re-transferred to the case base 1AA.

Based on the positional information of the so-fed card base 1AA detected by the sensor 7C, the controller 6 controls the operation of the card feeder KH so as to perform the cueing of a re-transfer area on the card base 1AA.

The cueing is carried out so that a re-transfer starting position on the card base 1AA coincides with the thermal head 13 (see FIG. 1A).

Based on the detection signal from the sensor 7C, the controller 6 selects, as a film area to be transferred at first, the first transfer area 21 from the transfer areas 21, 22 and further controls the operation of the intermediate-transfer film feeder TFH so that a re-transfer starting position on the first transfer area 21 coincides with the thermal head 13.

With the alignment of the intermediate-transfer film 11 with the card base 1AA, the controller 6 drives the head actuator HA2 to allow the thermal head 13 to press the intermediate-transfer film 13 onto the card base 1AA while feeding both of the film 13 and the card base 1AA. Simultaneously, the controller 6 heats up the thermal head 13 to release the ink receptor layer 11*d*1 and the protecting layer 11*c*1 (the transfer layer 11*cd*) in the first transfer area 21 of the intermediate-transfer film 11 from the release layer 11*b*, transferring (re-transferring) the released layer 11*cd* to the card base 1AA.

Thus, the transfer layer 11*cd* is re-transferred onto the card base 1AA so as to arrange the ink receptor layer 11*d*1 on the inner side of the card base 11AA and the protecting layer 11*c*1 on the outer side of the card base 11AA.

Thereafter, the re-cueing of the re-transfer area on the case base 1AA and the re-cueing of the second transfer area 22 in the intermediate-transfer film 13 are carried out. Then, similarly to the re-transfer of the first transfer area 21, the ink receptor layer 11*d*2 and the protecting layer 11*c*2 (the transfer layer 11*cd*) in the second transfer area 22 of the intermediate-transfer film 11 are released from the release layer 11*b* thereby to re-transfer the so-released transfer layer 11*cd* onto the previously-transferred transfer layer 11*cd* in the first transfer area 21 on the card base 1AA, in piles.

Figure 5:
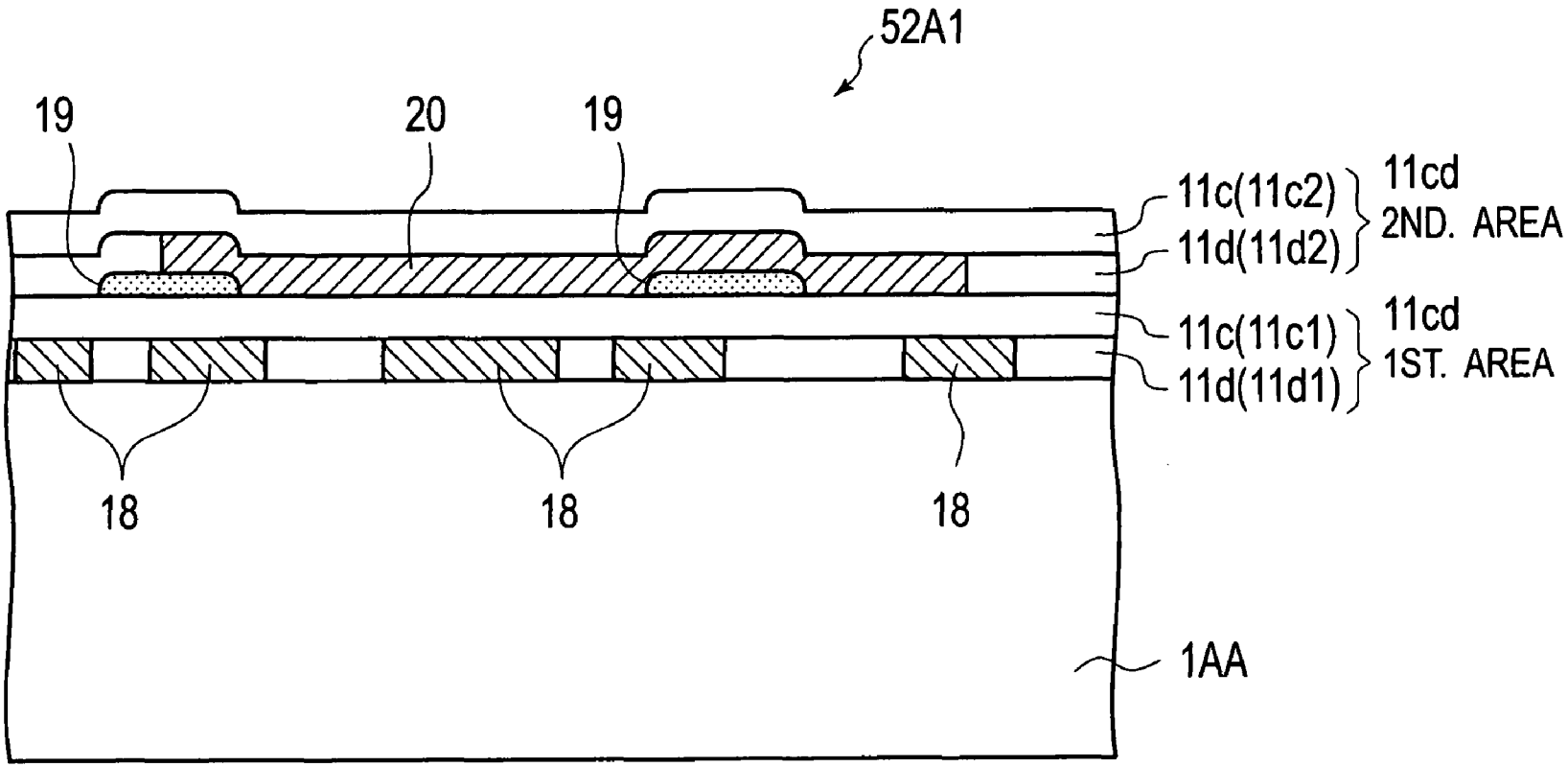
FIG. 5 is a sectional view explaining a card manufactured in transfer and re-transfer processes in the mode A1 in the re-transfer printing machine in the embodiment of the present invention.

This "overlapping" re-transfer will be described with reference to FIG. 5 in detail (partially including overlapped descriptions). FIG. 5 is a schematic sectional view of the re-transfer areas corresponding to the first and second transfer areas 21, 22 transferred to the card base 1AA in a card 52A1 as the object to be printed.

First of all, it is performed to re-transfer the transfer layer 11*cd*, which is arranged in the first transfer area 21 of the intermediate-transfer film 11 to have the sublimation-ink image 18, onto a designated re-transfer area of the card base 1AA. As a result of this re-transferring, the card base 1AA is overlaid with the transfer layer 11*cd*, that is, the ink receptor layer 11*d*1 and the protecting layer 11*c*1, in this order from the surface of the card base 1AA.

Next, the second transfer layer 11*cd* having the fusible-ink image 19 and the invisible-ink image 20 formed therein is re-transferred onto a card area where the first transfer area 21 has been re-transferred in advance, in piles.

Upon completion of the re-transfer process mentioned above, the card 52A1 is fabricated in the mode A1 selected by the data processor 76.

In the card 52A1, as shown in FIG. 5, a card's layer having the sublimation-ink image 18 formed therein is arranged close to the card base 1AA in comparison with another card's layer having the invisible-ink image 20 formed therein. The protecting layer 11*c*1 is interposed between the former card's layer and the latter card's layer.

It is noted that the sublimation-ink image 18 does not come into direct contact with the invisible-ink image 20 composed of an ultraviolet-emitting-ink image in the card 52A1. Therefore, when illuminating ultraviolet light to confirm the image 20 visually, the amount of fluorescent light radiated from the invisible-ink image 20 onto the sublimation-ink image 18 is reduced in diffusion since the fluorescent light is transmitted through the protecting layer 11*c*1. As a result, the color degradation of the sublimation inks is restrained, so that the sublimation-ink image 18 can be maintained for a long term favorably.

Note that if an ultraviolet-emitting ink as fluorescent ink comes in direct contact with a sublimation ink, there is a possibility that the color degradation of the sublimation ink is accelerated due to a reaction of both inks. However, according to the embodiment, both of the inks are insulated from each other through the protecting layer 11*c*1, the color degradation of the sublimation ink is prevented to allow the sublimation-ink image 18 to be maintained for a long term favorably.

In addition, if the protecting layer 11*c*1 is mixed with well-known ultraviolet absorbent or ultraviolet-diffusion material, then it is possible to reduce the influence of ultraviolet radiation on the sublimation ink.

In the card 52A1, as the invisible-ink image 20 is positioned on the front side of the card in comparison with the sublimation-ink image 18 or the fusible-ink image 19, an operator can confirm the invisible-ink image 20 in the fluorescent state more clearly.

In this way, the mode A1 is nothing but an operational mode to separate, in the intermediate-transfer film 11, a film's formation area for the sublimation-ink image 18 from a formation area for the invisible-ink image 20 and also to form the fusible-ink image 19 in the formation area for the invisible-ink image 20 in advance to the formation of the image 20.

(Mode A2)

The mode A2 will be described below.

The mode A2 is similar to the mode A1 in point of separating the formation area for the sublimation-ink image 18 from the formation area for the invisible-ink image 20. The mode A2 differs from the mode A1 in that the fusible-ink image 19 is formed in the formation area for the sublimation-ink image 18.

Figure 7:
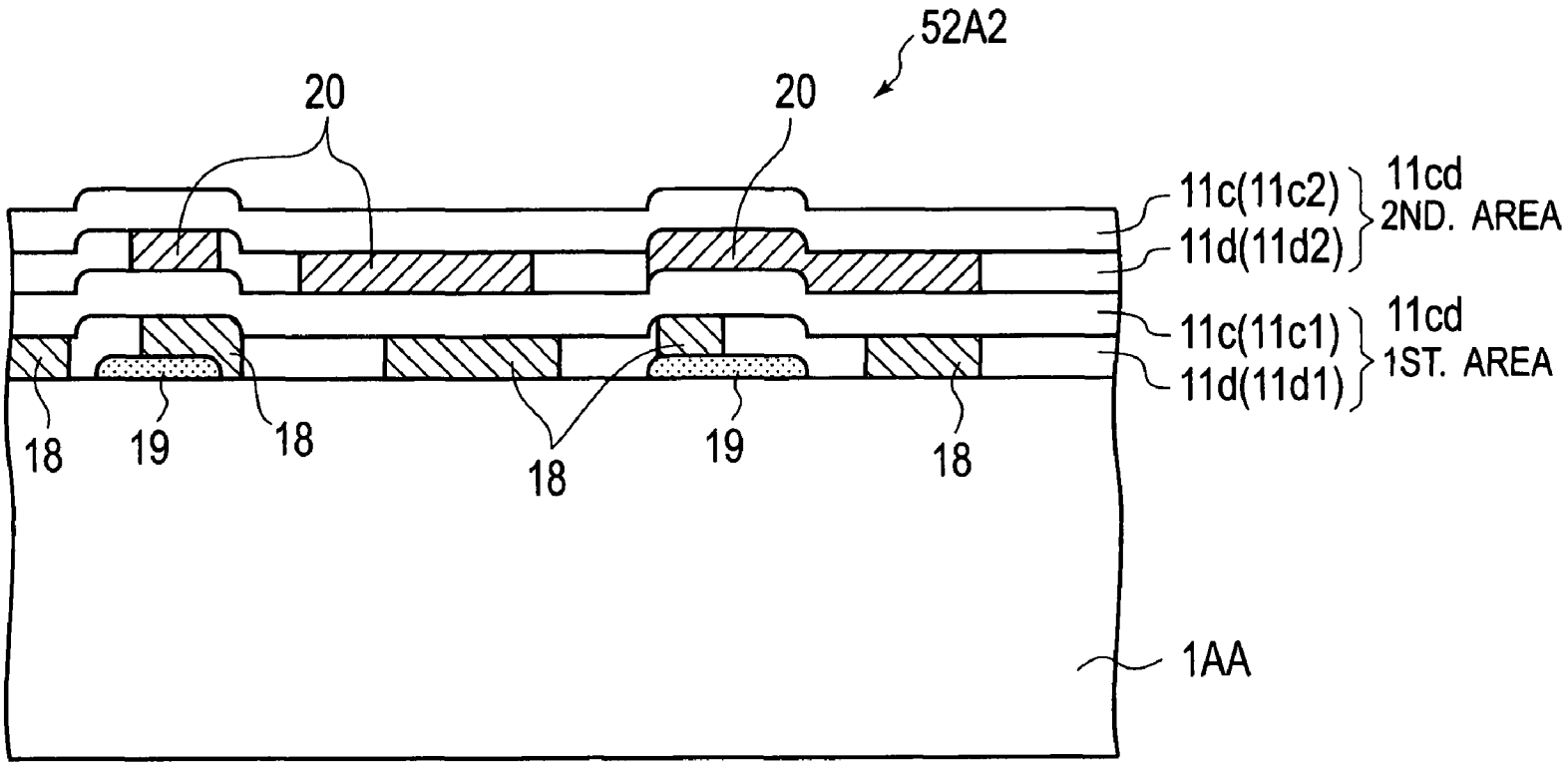
FIG. 7 is a sectional view explaining a card manufactured in the transfer and re-transfer processes in the mode A2 in the re-transfer printing machine in the embodiment of the present invention.

FIG. 7 shows a card 52A produced in the mode A2 selected by the data processor 76. In this example, the fusible-ink image 19 is re-transferred in a different position from that of the previously-mentioned card 52A1 in the mode A1 in the direction of lamination.

The re-transfer process for the card 52A will be described with reference to FIGS. 6 and 7, in detail.

Figure 6:
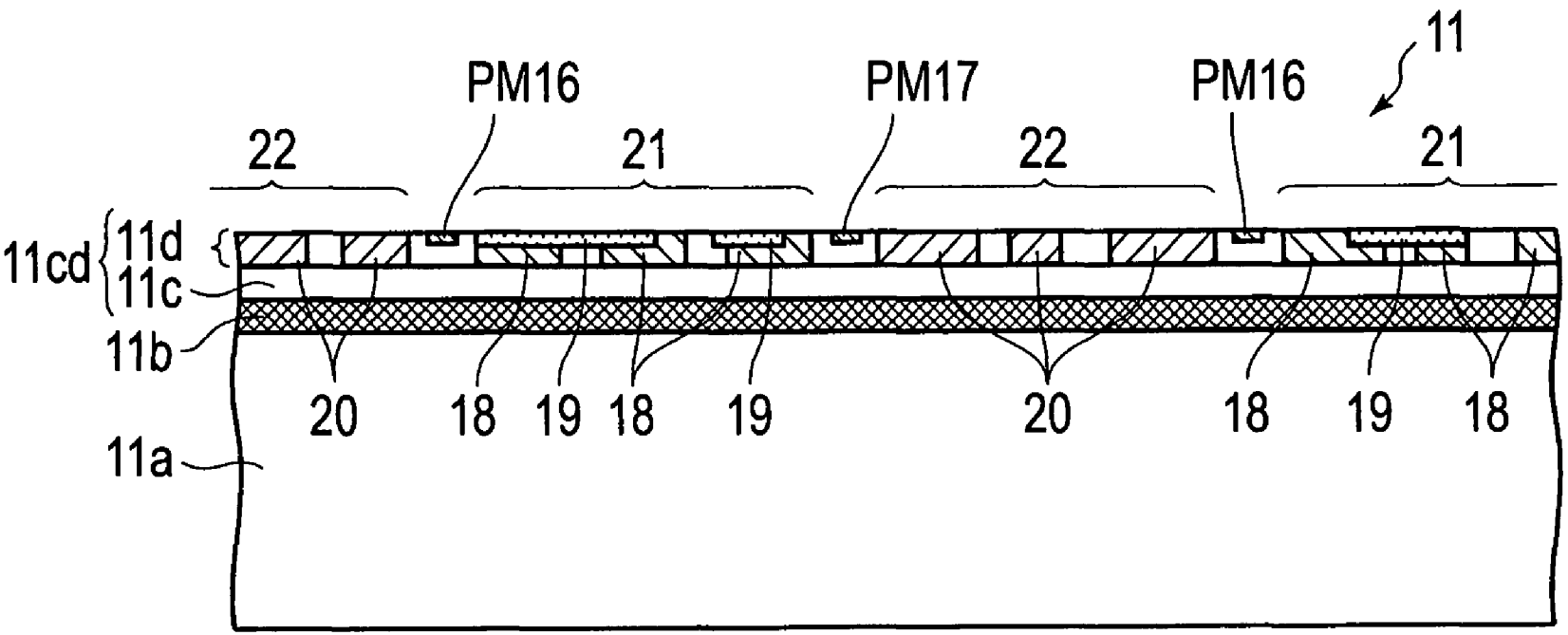
FIG. 6 is a sectional view explaining the transfer process in the mode A2 in the re-transfer printing machine in the embodiment of the present invention.

First of all, as shown in FIG. 6, respective print images of the sublimation-ink layers Y, M and C in the ink film 33 are transferred into each of the first transfer areas 21, in piles. As a result, the sublimation-ink image 18 is formed in the ink receptor layer 11*d* of the first transfer area 21.

In addition, the ink in the fusible-ink layer K of the ink film 33 is transferred into the first transfer area 21, as well. Consequently, the fusible-ink image 19 is formed on the front side of the ink receptor layer 11*d*1 in the first transfer area 21.

While, into the ink receptor layer 11*d*2 in a second transfer area 22 situated next to the first transfer area 21 through a predetermined interval, an ink of the ultraviolet-emitting-ink layer UVS is transferred to form the invisible-ink image 20.

Also in this case, the first and second transfer areas 21, 22 for the ink images 18 to 20 are previously established in the intermediate-transfer film 11. Between the first transfer area 21 and the second transfer area 22, there are position marks PM16, PM17 enabling these areas 21, 22 to be specified. These position marks are detected by the sensor 7B, while the controller 6 judges the positioning of the intermediate-transfer film 11, based on the detection signals from the sensor 7B.

In this way, the ink images 18 to 20 re-transferred to the intermediate-transfer film 11 are re-transferred to the case base 1AA.

This re-transfer operation will be described with reference to FIGS. 6 and 7, in detail. FIG. 5 is a schematic sectional view of the card 52A in the range generally corresponding to the first and second transfer areas 21, 22 transferred onto the card base 1AA.

First of all, as shown in FIG. 7, it is performed to re-transfer the transfer layer 11*cd*, which is arranged in the first transfer area 21 of the intermediate-transfer film 11 to have the sublimation-ink image 18 and the fusible-ink image 19, onto a designated re-transfer area of the card base 1AA. As a result of this re-transferring, the card base 1AA is overlaid with the transfer layer 11*cd*, that is, the ink receptor layer 11*d*1 and the protecting layer 11*c*1, in this order from the surface of the card base 1AA.

As mentioned before, the fusible-ink image 19 is formed, in the ink receptor layer 11*d*1, on the front side of the intermediate-transfer film 11. Therefore, at the stage of completing to re-transfer images, the fusible-ink image 19 is positioned, in the ink receptor layer 11*d*1, on the side of the card base 1AA, as shown in FIG. 7.

Next, the second transfer layer 11*cd* having the invisible-ink image 20 formed therein is re-transferred onto a card area where the first transfer area 21 has been re-transferred in advance, in piles.

Consequently, the ink receptor layer 11*d*2 containing the invisible-ink image 20 is interposed between the protecting layer 11*d*1 and the protecting layer 11*c*2.

Upon completion of the re-transfer process mentioned above, the card 52A1 is fabricated in the mode A2 selected by the data processor 76.

In the card 52A2, as shown in FIG. 5, a card's layer having the sublimation-ink image 18 formed therein is arranged close to the card base 1AA in comparison with another card's layer having the invisible-ink image 20 formed therein. The protecting layer 11*c*1 is interposed between the former card's layer and the latter card's layer.

In the card 52A2, the sublimation-ink image 18 does not come into direct contact with the invisible-ink image 20 composed of an ultraviolet-emitting-ink image in the card 52A1. Therefore, when illuminating ultraviolet light to confirm the image 20 visually, the amount of fluorescent light radiated from the invisible-ink image 20 onto the sublimation-ink image 18 is reduced in diffusion since the fluorescent light is transmitted through the protecting layer 11*c*1. As a result, the color degradation of the sublimation inks is restrained, so that the sublimation-ink image 18 can be maintained for a long term favorably.

Again, if an ultraviolet-emitting ink as fluorescent ink comes in direct contact with a sublimation ink, there is a possibility that the color degradation of the sublimation ink is accelerated due to a reaction of both inks. In the card 52A2 of this embodiment, however, both of the inks are insulated from each other through the protecting layer 11*c*1. For this reason, the color degradation of the sublimation ink is prevented to allow the sublimation-ink image 18 to be maintained for a long term favorably.

In addition, if the protecting layers 11*c* (11*c*1, 11*c*2) are mixed with well-known ultraviolet absorbent or ultraviolet-diffusion material, then it is possible to reduce the influence of ultraviolet radiation on the sublimation ink.

In particular, in case of the protecting layers 11*c*1 mixed with well-known ultraviolet absorbent or ultraviolet-diffusion material, then it becomes possible to reduce the influence of ultraviolet radiation on the sublimation ink more effectively.

In the card 52A2, as the invisible-ink image 20 is positioned on the front side of the card in comparison with the sublimation-ink image 18 or the fusible-ink image 19, an operator can confirm the invisible-ink image 20 in the fluorescent state more clearly.

In connection with the above-mentioned embodiment, we now cite materials available for respective inks and films although they may be partially overlapped with the citation in the previous description.

- base sheet 33*a* for the ink film 33: plastics (e.g. polyester, polypropylene, polyethylene), condenser paper, etc. (thickness: 0.003 mm~0.010 mm)
- sublimation-ink layer: applying disperse dyes (respective colors) with resinous binder on the base sheet 33*a*
- fusible-ink layer: applying carbon-black (as color fixing agent) with resinous binder on the base sheet 33*a*
- $1^{st}$. and $2^{nd}$. protecting ink: acrylic resin, polyester resin, polyurethane resin, etc.
- invisible ink UVS: as invisible (colorless) fluorescent material, using organic compound or pigment containing crystalline metal-oxide or crystalline sulphide in major proportions Note that the invisible ink may exhibit not only fluorescence against ultraviolet radiation but also infra-red radiation. In any case, it is more desirable that the protecting layers 11*c*1, 11*c*2 are characterized so as to allow light in the wavelength range of fluorescence of the invisible ink to be transmissible with difficulty.

- base 11*a* of intermediate transfer film 11: plastics (e.g. polyester, polypropylene, polyethylene) or condenser paper (thickness: 0.01 mm~0.05 mm)
- release layer 11*b*: forming of thermoplastic resin (e.g. acrylate resin, polyester resin, polyurethane resin) plus mold-releasing material (as additive)
- ink receptor layer 11*c*: forming of polyester resin, polyvinyl resin, cellulosic resin, etc.
- protecting layer 11*d*: forming of polyurethane resin, acrylate resin, polyethylene resin, etc.

In common with the modes A1 and A2 mentioned above, it is performed to separate the formation area (i.e. the first transfer area 21) for the sublimation-ink image 18 and the formation area (i.e. the second transfer area 22) for the invisible-ink image 20 from each other in the intermediate-transfer film 11. Further, in the re-transfer process, it is performed to overprint the first transfer area 21 and the second transfer area 22 on the printed object, in this order.

Therefore, in the intermediate-transfer film 11, there are consumed two areas with respect to each operation of producing a signal card. Note that the two areas may be called to as "two panels", hereinafter.

The above-mentioned printing form (in the modes A1, A2) could have a great effect on an object to be printed with such a print layout where the sublimation-ink image 18 and the invisible-ink image 20 should be overlaid with each other. On the contrary, in non-overlaying layout, there is no possibility that the sublimation ink is directly exposed to fluorescence of the invisible-ink image 20 even if ultraviolet light is illuminated in order to confirm information printed in the invisible ink. In this case, the color degradation is not accelerated and therefore, there is no possibility that a card's available period is shortened.

Therefore, under a situation that it is unnecessary to overlap sublimation-ink image 18 on the invisible-ink image 20 in the print layout, there is no need of consuming two panels (areas) in the intermediate-transfer film in the above-mentioned mode A1 or A2 in order to avoid the color degradation of the sublimation inks.

Accordingly, in the card printing apparatus 60 of this embodiment, the data processor 76 detects the presence/absence of an overlapping between the sublimation-ink image 18 and the invisible-ink image in a desired print layout. If the desired print layout includes the overlapping of the images 18, 20, the processor 76 selects either the mode A1 or the mode A2. While, if there is no overlapping of the images 18, 20 in the desired print layout, then the processor 76 determines whether the fusible-ink image 19 and the invisible-ink image 20 overlap each other or not. If the desired print layout includes the overlapping of the images 19, 20, the processor 76 selects an operational mode B1. While, if there is no overlapping of the images 19, 20 in the desired print layout, the processor 76 selects another operational mode B2.

The above-mentioned modes B1 and B2 will be described in advance of describing the data processor 76, in detail.

In common with the modes B1, B2, the sublimation-ink image 18, the fusible-ink image 19 and the invisible-ink image 20 are together formed in a single image-formation area (also called to as "one panel", after).

The mode B1 differs from the mode B2 in the forming order of the fusible-ink image 19 and the invisible-ink image 20.

(Mode B1)

Figure 8:
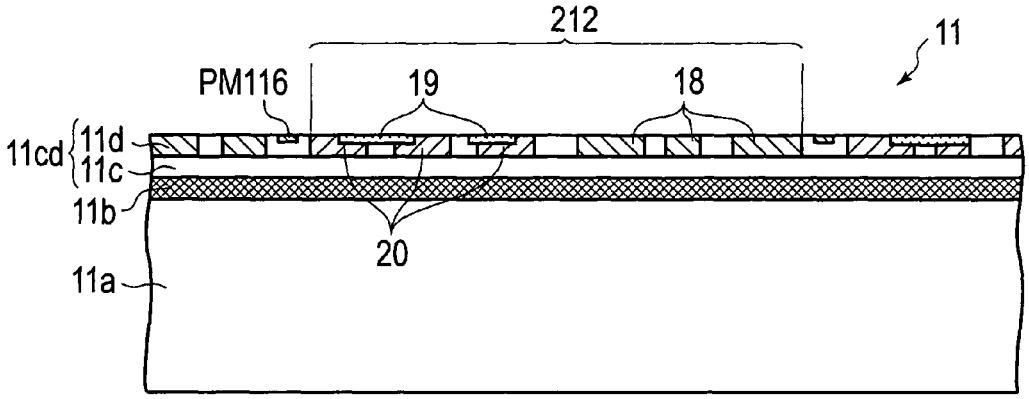
FIG. 8 is a sectional view explaining a transfer process in the mode B1 in the re-transfer printing machine in the embodiment of the present invention.

FIG. 8 is a schematic sectional view of the intermediate-transfer film 11 after the transfer operation performed by the controller 6, based on the mode B1 established by the data processor 76.

In the transfer operation for the intermediate-transfer film 11, the sublimation inks in respective colors Y, M and C are transferred to an identical transfer area 212, in piles.

While, in an area part of the transfer area 212 having no sublimation ink transferred, respective inks of the ultraviolet-emitting-ink layer UVS and the fusible-ink layer K are transferred so that they overlap each other.

That is, by repeating the cueing of the transfer area 212 and the cueing of respective colors in the ink film 33, respective sublimation-inks in colors Y, M and C are transferred into the ink receptor layer 11*d* of the transfer area 212. As a result, a sublimation-ink image 18 is formed in the ink receptor layer 11*d*.

This image can be printed in full colors with remarkably-high grade and therefore, it is better suited for facial portrait.

For the ink receptor layer 11*d* in the area part of the transfer area 212 having no sublimation-ink image, ink of the ultraviolet-emitting-ink layer UVS is firstly transferred to form an invisible-ink image 20. In succession, ink of the fusible-ink layer K is transferred so as to overlap the image 20, forming a fusible-ink image 19.

Thus, the later-formed fusible-ink image 19 is positioned on the front side of the ink receptor layer 11*d*.

In this way, the transfer area 212 having the ink images 18 to 20 formed therein is previously established in the intermediate-transfer film 11. On both sides of the transfer area 212, there are position marks PM116 enabling the area 212 to be specified. These position marks are detected by the sensor 7B, while the controller 6 judges the positioning of the intermediate-transfer film 11, based on the detection signals from the sensor 7B.

In this way, the ink images 18 to 20, which have been transferred to the intermediate-transfer film 11, are re-transferred to the case base 1AA.

Based on the positional information of the so-fed card base 1AA detected by the sensor 7C, the controller 6 controls the operation of the card feeder KH so as to perform the cueing of a re-transfer area on the card base 1AA.

The cueing is carried out so that a re-transfer starting position on the card base 1AA coincides with the thermal head 13 (see FIG. 1A).

Based on the detection signal from the sensor 7C, the controller 6 controls the operation of the intermediate-transfer film feeder TFH so that a re-transfer starting position on the transfer area 212 coincides with the thermal head 13.

With the alignment of the intermediate-transfer film 11 with the card base 1AA, the controller 6 drives the head actuator HA2 to allow the thermal head 13 to press the intermediate-transfer film 13 onto the card base 1AA while feeding both of the film 13 and the card base 1AA. Simultaneously, the controller 6 heats up the thermal head 13 to release the ink receptor layer 11*d* and the protecting layer 11*c* (the transfer layer 11*cd*) in the transfer area 212 of the intermediate-transfer film 11 from the release layer 11*b*, transferring (re-transferring) the released layer 11*cd* to the card base 1AA.

Thus, the transfer layer 11*cd* in the transfer area 212 is re-transferred onto the card base 1AA in a manner that the ink receptor layer 11*d* is positioned on the inner side of the card base 11AA and that the protecting layer 11*c* is positioned on the outer side of the card base 11AA.

Figure 9:
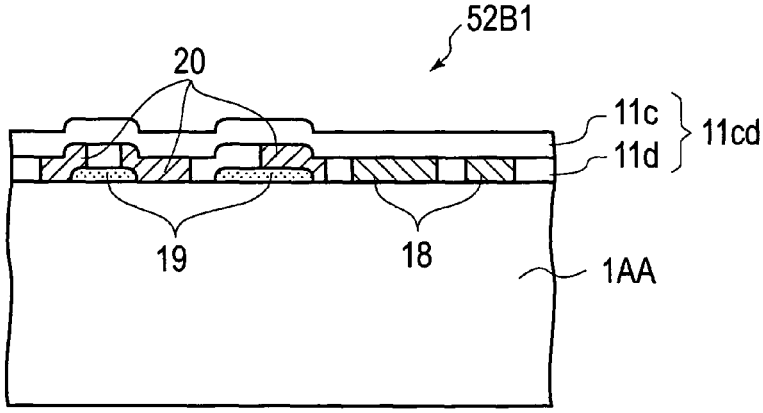
FIG. 9 is a sectional view explaining a card manufactured in transfer and re-transfer processes in the mode B1 in the re-transfer printing machine in the embodiment of the present invention.

This re-transfer operation will be described with reference to FIG. 9 in detail (partially including overlapped descriptions). FIG. 9 is a schematic sectional view of the re-transfer area corresponding to the transfer area 212 transferred to the card base 1AA in a card 52 as the object to be printed.

First of all, it is performed to re-transfer the transfer layer 11*cd*, which is arranged in the transfer area 212 of the intermediate-transfer film 11 and provided with the ink images 18 to 20, onto a designated re-transfer area of the card base 1AA. As a result of this re-transferring, the card base 1AA is overlaid with the transfer layer 11*cd*, that is, the ink receptor layer 11*d* and the protecting layer 11*c*, in this order from the surface of the card base 1AA.

Upon completion of the re-transfer process mentioned above, the card 52B1 is fabricated in the mode B1 selected by the data processor 76.

In the card 52B1, according to the mode B1, the sublimation-ink image 18 and the invisible-ink image 20 are formed in different areas in the identical ink receptor layer 11*d* overlaid with the protecting layer 11*c*.

Thus, in the card 52B1, the sublimation-ink image 18 and the invisible-ink image 20 composed of an ultraviolet-emitting-ink image are laid so that they do not overlap each other and additionally, the sublimation-ink image 18 does not come into direct contact with the invisible-ink image 20. Therefore, when illuminating ultraviolet light to confirm the image 20 visually, the fluorescent light radiated from the invisible-ink image 20 onto the sublimation-ink image 18 does not illuminate the invisible ink directly. As a result, the color degradation of the sublimation inks is restrained, so that the sublimation-ink image 18 can be maintained for a long term favorably.

In the card 52B1, as the invisible-ink image 20 is positioned on the front side of the card in comparison with the fusible-ink image 19, an operator can confirm the invisible-ink image 20 in the fluorescent state more clearly.

(Mode B2)

Figure 10:
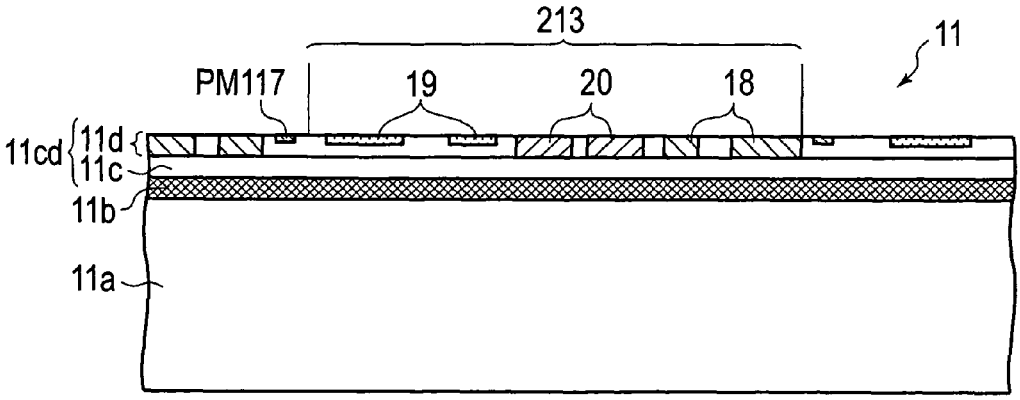
FIG. 10 is a sectional view explaining a transfer process in the mode B2 in the re-transfer printing machine in the embodiment of the present invention.

Next, the mode B2 will be described below. FIG. 10 is a schematic sectional view of the intermediate-transfer film 11 after the transfer operation performed by the controller 6, based on the mode B2 established by the data processor 76.

In the transfer operation for the intermediate-transfer film 11, the sublimation inks in respective colors Y, M and C are transferred to an identical transfer area 213, in piles.

While, in the transfer area 213, ink of the ultraviolet-emitting-ink layer UVS is transferred into an area part (213) where no sublimation ink is transferred. In the transfer area 213, ink of the fusible-ink layer K is transferred into another area part (213) where neither sublimation ink nor ultraviolet emitting ink is transferred.

That is, by repeating the cueing of the transfer area 213 and the cueing of respective colors in the ink film 33, respective sublimation-inks in colors Y, M and C are transferred into the ink receptor layer 11*d* of the transfer area 213. As a result, a sublimation-ink image 18 is formed in the ink receptor layer 11*d*.

This image can be printed in full colors with remarkably-high grade and therefore, it is better suited for facial portrait.

For the ink receptor layer 11*d* in the area part of the transfer area 213 having no sublimation-ink image, ink of the fusible-ink layer K is firstly transferred to form a fusible-ink image 19. In succession, for the ink receptor layer 11*d* in the area part where the sublimation-ink image 18 and the fusible-ink image 19 are not transferred, ink of the ultraviolet-emitting-ink layer UVS is transferred to form an invisible-ink image 20.

In this way, the transfer area 213 having the ink images 18 to 20 formed independently of each other is previously established in the intermediate-transfer film 11. On both sides of the transfer area 213, there are position marks PM117 enabling the area 213 to be specified. These position marks are detected by the sensor 7B, while the controller 6 judges the positioning of the intermediate-transfer film 11, based on the detection signals from the sensor 7B.

In this way, the ink images 18 to 20, which have been transferred to the intermediate-transfer film 11, are re-transferred to the case base 1AA.

Based on the positional information of the so-fed card base 1AA detected by the sensor 7C, the controller 6 controls the operation of the card feeder KH so as to perform the cueing of a re-transfer area on the card base 1AA.

The cueing is carried out so that a re-transfer starting position on the card base 1AA coincides with the thermal head 13 (see FIG. 1A).

Based on the detection signal from the sensor 7C, the controller 6 controls the operation of the intermediate-transfer film feeder TFH so that a re-transfer starting position on the transfer area 213 coincides with the thermal head 13.

With the alignment of the intermediate-transfer film 11 with the card base 1AA, the controller 6 drives the head actuator HA2 to allow the thermal head 13 to press the intermediate-transfer film 13 onto the card base 1AA while feeding both of the film 13 and the card base 1AA. Simultaneously, the controller 6 heats up the thermal head 13 to release the ink receptor layer 11*d* and the protecting layer 11*c* (the transfer layer 11*cd*) in the transfer area 213 of the intermediate-transfer film 11 from the release layer 11*b*, transferring (re-transferring) the so-released layer 11*cd* to the card base 1AA.

Thus, the transfer layer 11*cd* in the transfer area 213 is re-transferred onto the card base 1AA in a manner that the ink receptor layer 11*d* is positioned on the inner side of the card base 11AA and that the protecting layer 11*c* is positioned on the outer side of the card base 11AA.

Figure 11:
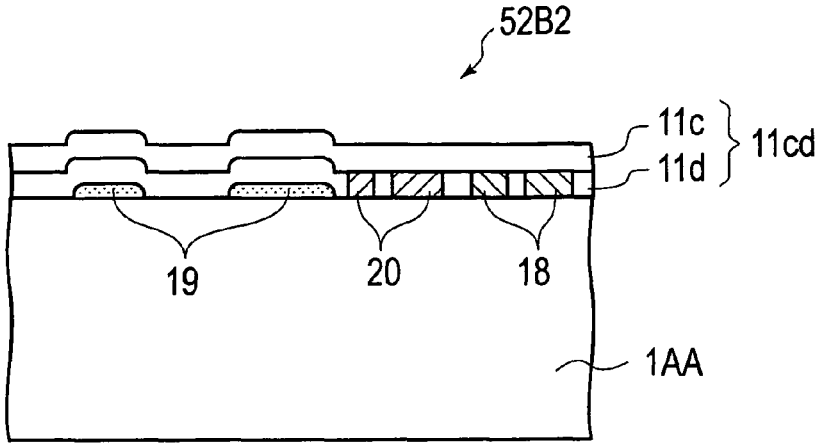
FIG. 11 is a sectional view explaining a card manufactured in transfer and re-transfer processes in the mode B2 in the re-transfer printing machine in the embodiment of the present invention.

This re-transfer operation will be described with reference to FIG. 11 in detail (partially including overlapped descriptions). FIG. 11 is a schematic sectional view of the re-transfer area corresponding to the transfer area 213 transferred to the card base 1AA in a card 52 as the object to be printed.

In this re-transfer operation, it is performed to re-transfer the transfer layer 11*cd*, which is arranged in the transfer area 213 of the intermediate-transfer film 11 and provided with the ink images 18 to 20, onto a designated re-transfer area of the card base 1AA. As a result, the card base 1AA is overlaid with the transfer layer 11*cd*, that is, the ink receptor layer 11*d* and the protecting layer 11*c*, in this order from the surface of the card base 1AA.

Upon completion of the re-transfer process mentioned above, the card 52B2 is fabricated in the mode B2 selected by the data processor 76.

In the card 52B2, according to the mode B2, the sublimation-ink image 18, the invisible-ink image 20 and the fusible-ink image 19 are formed in different areas in the identical ink receptor layer 11*d*, independently of each other. Further, the ink receptor layer 11*d* is overlaid with the protecting layer 11*c*.

Thus, in the card 52B2, the sublimation-ink image 18 and the invisible-ink image 20 composed of an ultraviolet-emitting-ink image are laid so that they do not overlap each other. In addition, the sublimation-ink image 18 does not come into direct contact with the invisible-ink image 20. Therefore, when illuminating ultraviolet light to confirm the image 20 visually, the fluorescent light radiated from the invisible-ink image 20 onto the sublimation-ink image 18 does not illuminate the invisible ink directly. As a result, the color degradation of the sublimation inks is restrained, so that the sublimation-ink image 18 can be maintained for a long term favorably.

As mentioned above, as the intermediate-transfer film 23 necessary for manufacturing one card (printed object) is composed of one panel (single area) of film in common with the modes B1 and B2, the film consumption, can be, reduced by half in comparison with that in the modes A1 and A2.

Next, the data processor 76 will be described below.

Figure 12:
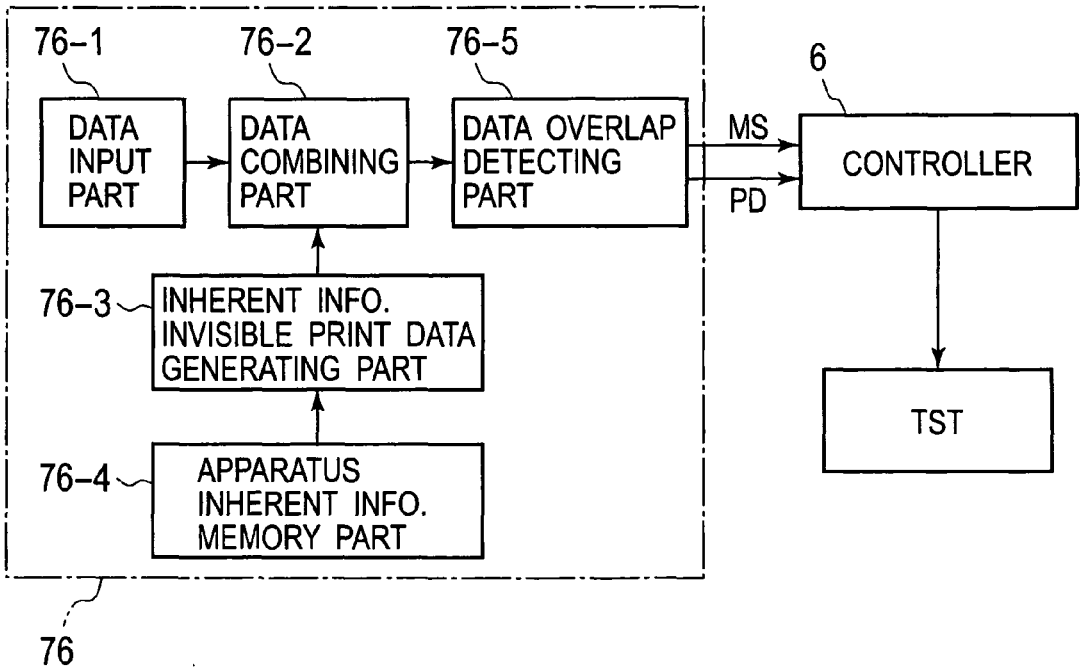
FIG. 12 is a block diagram explaining the re-transfer printing machine in the embodiment of the present invention.

FIG. 12 is a block diagram of the data processor 76 in one embodiment.

In FIG. 12, "TST" denotes a transfer/re-transfer unit which is representative of the card feeder KH, the ink film feeder IFH, the sensors 7A to 7C, the thermal heads HA, HA2 and the intermediate-film feeder THF.

The data processor 76 comprises a data input part 76-1, a data combining part 76-2, an inherent-information invisible print data generating part 76-3, an apparatus inherent-information memory part 76-4 and a data overlap detecting part 76-5 (as the overlap detecting unit of the invention).

(Re. Data Input Part 76-1)

The data input part 76-1 is formed by an input unit through which a user can input print data to be printed in respective inks. There are widely-known devices (e.g. keyboard, image display unit/mouse pointer, etc.) available for the input unit.

(Re. Apparatus Inherent-information Memory Part 76-4)

The apparatus Inherent-information Memory Part 76-4 will be referred to as "memory part" hereinafter.

The memory part 76-4 stores a manufacturer's serial number of the card manufacturing apparatus 60, as its inherent information KJ.

As the other inherent information KJ, for example, there is a MAC (Media Access Control) address for network connection to specify the card manufacturing apparatus 60.

In case of MAC address, even if the card manufacturing apparatus 60 is connected to a network, it is possible to specify the apparatus 60. Further, even when exchanging a circuit board to another one in its trouble-shooting or maintenance, it is possible to track the history of the apparatus with high accuracy by renewing and storing the information about a new circuit board in replacement. Thus, the memory part 76-4 is advantageous in terms of traceability of the apparatus, especially.

(Re. Inherent-information Invisible Print Data Generating Part 76-3)

The inherent-information invisible print data generating part 76-3 will be referred to as "invisible-data generating part" hereinafter.

The invisible-data generating part 76-3 reads out the inherent information KJ stored in the memory part 76-4 and generates, as area data, print data about which area in the card the readout information KJ should be printed.

If the inherent information KJ includes a plurality of inherent informative elements, one or more informative elements are selected in accordance with an indication from the data input part 76-1.

(Re. Data Combining Part 76-2)

The data combining part 76-2 combines the print data inputted to the data input part 76-1 with the inherent information (i.e. the area data) generated by the invisible-data generating part 76-3 thereby to produce data about the print layout.

Regarding the size and position of an area to be printed in respective inks, there are prepared a preset typical mode and an optionally-settable manual mode, allowing a user to do the layout freely.

(Re. Data Overlap Detecting Part 76-5)

The data overlap detecting part 76-5 will be referred to as "overlap detecting part" hereinafter.

Based on the print layout established in the data combining part 76-2, the overlap detecting part 76-5 detects whether or not the invisible-ink image 20 and the sublimation-ink image 18 are overlapping each other and whether or not the invisible-ink image 20 and the fusible-ink image 19 are overlapping each other and subsequently outputs a later-mentioned mode signal MS together with the print data PD to the controller 6.

Figure 13:
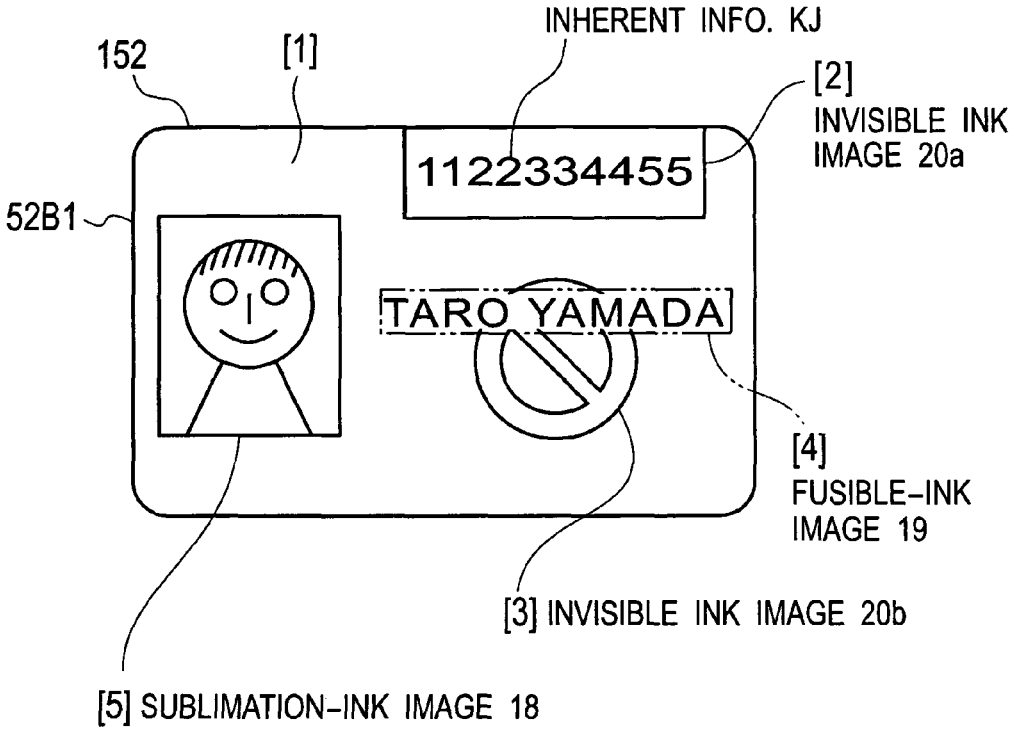
FIG. 13 is a view showing an example of printing layout in a care manufacture by the re-transfer printing machine in the embodiment of the present invention.

This detecting operation will be described with reference to FIG. 13 illustrating one example of print pattern and FIG. 14 (flow chart).

FIG. 13 shows a printed card 152. In the shown example, the fusible-ink image 19 and the invisible-ink image 20 are overlapping each other, while the invisible-ink image 20 and the sublimation-ink image 18 are not overlapping each other, corresponding to the card 52B1 transferred and re-transferred in the mode B1. The card 162 further includes two formation areas for invisible-ink images independent of each other (i.e. later-mentioned print areas [2] and [3]).

Within an overall print area [1], the card 152 includes a plurality of printed elements: a sublimation-ink image 18 in the form of a full-color photograph, which is formed in a print area [5] by respective sublimation inks Y, M and C; a fusible-ink image 19 in the form of a letter string, which is formed in a print area [2] by a fusible ink; an invisible-ink image 20*a* containing the inherent information KJ, which is formed in the above print area [2] by an invisible ink; and an invisible-ink image 20*b* in the form of a prohibitive mark, which is formed in the above print area [3] by an invisible ink. Below, the invisible-ink image 20*a* and 20*b* will be referred to as "invisible-ink image 20" collectively.

As mentioned above, in the illustrated example, the print areas [3] and [4] are laid so that they overlap each other.

Figure 14:
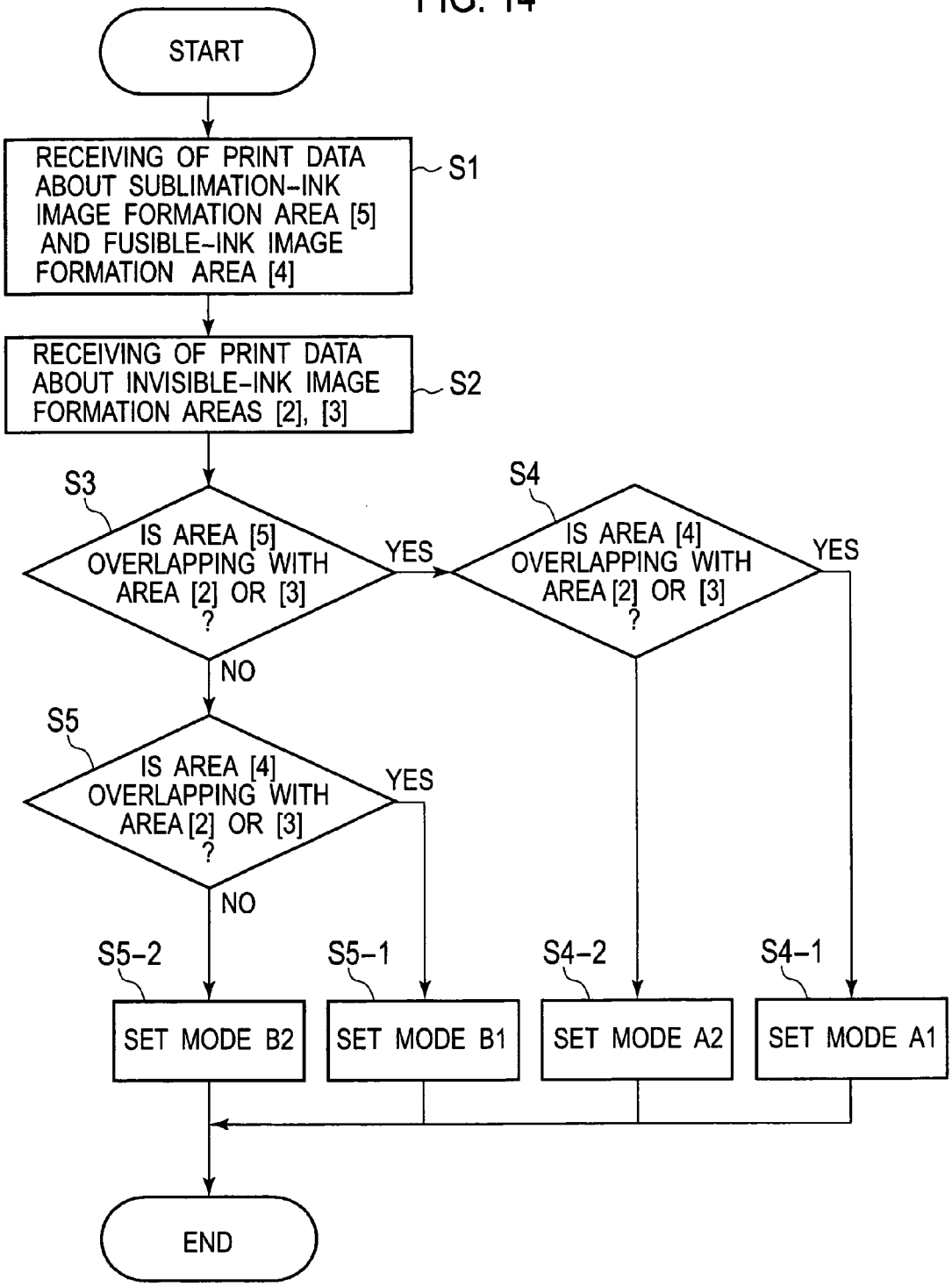
FIG. 14 is a flow chart explaining the operation of the re-transfer printing machine in the embodiment of the present invention.

Referring to FIG. 14, the overlap detecting operation of the overlap detecting part 76-5 against the printed information of the card 152 will be described below.

(Step S1)

It is executed to get both print data for the sublimation-ink image formation area [5] and print data for the fusible-ink image formation area [4] from the data combining part 76-2.

(Step S2)

It is executed to get both print data for the invisible-ink image formation area [2] and print data for the invisible-ink image formation area [3] from the invisible-data generating part 76-3.

(Step S3)

It is executed to judge whether or not the sublimation-ink image formation area [5] overlaps the invisible-ink image formation area [2] or the invisible-ink image formation area [3].

(Step S4)

If it is judged at step S3 that the sublimation-ink image formation area [5] is overlapping the invisible-ink image formation area [2] or [3] (i.e. a judgment of Yes), it is executed to further judge whether or not the fusible-ink image formation area [4] overlaps the invisible-ink image formation area [2] or [3].

(Step S4-1)

If it is judged at step S4 that the fusible-ink image formation area [4] is overlapping the invisible-ink image formation area [2] or [3] (Yes), it is executed to set the transfer/re-transfer operation to the mode A1.

(Step S4-2)

If it is judged at step S4 that the fusible-ink image formation area [4] is not overlapping the invisible-ink image formation area [2] or [3] (i.e. a judgment of No), it is executed to set the transfer/re-transfer operation to the mode A2.

(Step S5)

If it is judged at step S3 that the sublimation-ink image formation area [5] is not overlapping the invisible-ink image formation area [2] or [3] (No), it is executed to further judge whether or not the fusible-ink image formation area [4] overlaps the invisible-ink image formation area [2] or [3].

(Step S5-1)

If it is judged at step S5 that the fusible-ink image formation area [4] is overlapping the invisible-ink image formation area [2] or [3] (Yes), it is executed to set the transfer/re-transfer operation to the mode B1.

(Step S5-2)

If it is judged at step S5 that the fusible-ink image formation area [4] is not overlapping the invisible-ink image formation area [2] or [3] (i.e. a judgment of No), it is executed to set the transfer/re-transfer operation to the mode B2.

In the card 152 shown in FIG. 13, as the fusible-ink image formation area [4] is overlapping the invisible-ink image formation area [3], the overlap detecting part 76-5 judges "Yes" at step S5 and successively sets the transfer/re-transfer operation to the mode B1.

Next, the overlap detecting part 76-5 outputs the kind of mode in the form of a mode signal MS.

In response with the mode signal MS from the overlap detecting part 76-5, the controller 6 controls the operation of the apparatus.

The overlap detecting part 76-5 further sets the transfer/re-transfer mode and outputs the print data for the card.

Again the controller 6 allows the thermal mead 5 to perform the transfer operation of the print data.

As mentioned above, the card manufacturing apparatus 60 is constructed so as to detect the presence/absence of the overlapping between the invisible-ink image formation area and the sublimation-ink image formation area and further select either the mode A1 (or A2) for consuming two panels (areas) with respect to each object to be printed or the mode B1 (or B2) for consuming one panel with respect to each object, based on the above detection result.

Then, when selecting the mode B1 or B2 (i.e. absence of the overlapping between the invisible-ink image and the sublimation-ink image), it is possible to prevent a wastefulness of the intermediate-transfer film since the color degradation of the invisible ink is hard to occur due to the above arrangement. While, when selecting the mode A1 or A2 (i.e. presence of the overlapping between the invisible-ink image and the sublimation-ink image), it is performed to use two panels (two areas) in the intermediate-transfer film, avoiding the occurrence of color degradation of the invisible ink.

Thus, according to this manufacturing apparatus and method, it is possible to always prevent the occurrence of color degradation of the invisible ink while preventing a needless consumption of the intermediate-transfer film.

In addition, it is performed to select either the mode A1 or the mode A2 (or either the mode B1 or the mode B2) corresponding to the presence/absence of overlapping between the invisible-ink image and the fusible-ink image.

When there is no overlapping between the invisible-ink image and the fusible-ink image, it is carried out to set the operation to the mode A2 or the mode B2. In common with the modes A2 and B2, as the transfer operation of the invisible-ink image is carried out after the transfer operation of the fusible-ink image, there is no possibility that the invisible-ink image is influenced by the transfer operation of the fusible-ink image.

$2^{nd}$. Embodiment

Different from the above-mentioned embodiment, a card manufacturing apparatus may be constructed so as not to detect the overlapping between the invisible-ink image and the fusible-ink image but transferring the invisible ink and the fusible ink in a predetermined transfer order.

Note that the predetermined transfer order means the order of forming ink layers of the ink film 33. That is, according to the order, the invisible ink is first transferred to form an invisible-ink image and subsequently, the fusible is transferred to form a fusible-ink image.

Figure 16:
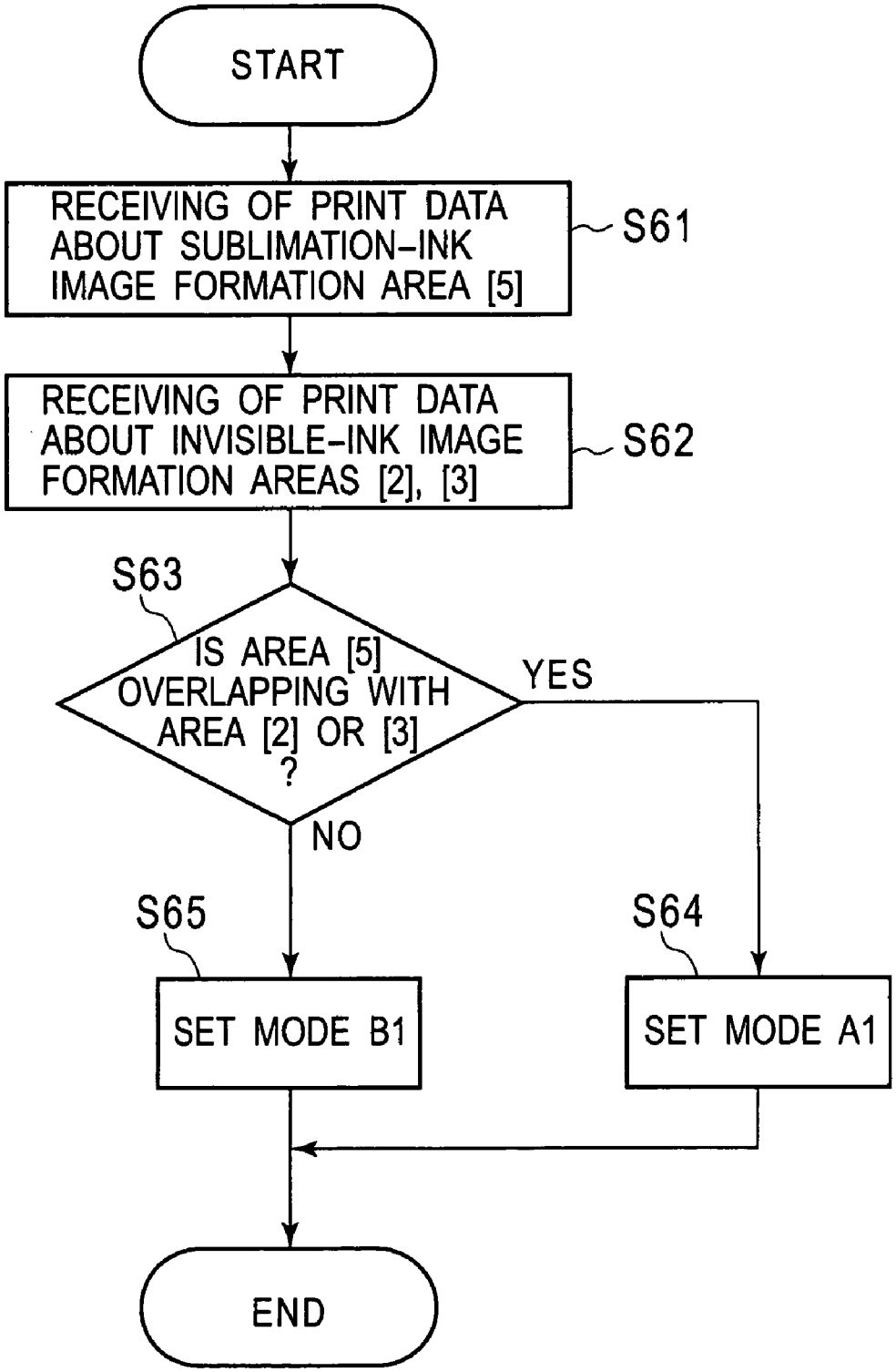
FIG. 16 is a flow chart explaining the operation of the re-transfer printing machine in another embodiment of the present invention.

The overlap detecting operation of the overlap detecting part 76-5 in the second embodiment is described with reference to a flow chart of FIG. 16, below.

(Step S61)

It is executed to receive print data for the sublimation-ink image formation area [5] from the data combining part 76-2.

(Step S62)

It is executed to get both print data for the invisible-ink image formation area [2] and print data for the invisible-ink image formation area [3] from the invisible-data generating part 76-3.

(Step S63)

It is executed to judge whether or not the sublimation-ink image formation area [5] overlaps the invisible-ink image formation area [2] or the invisible-ink image formation area [3].

(Step S64)

If it is judged at step S63 that the sublimation-ink image formation area [5] is overlapping the invisible-ink image formation area [2] or [3] (i.e. a judgment of Yes), it is executed to set the transfer/re-transfer operation to the mode A1.

(Step S65)

If it is judged at step S63 that the sublimation-ink image formation area [5] is not overlapping the invisible-ink image formation area [2] or [3] (i.e. a judgment of No), it is executed to set the transfer/re-transfer operation to the mode B1.

According to the second embodiment, the transfer operations for the fusible ink and the invisible ink are performed in the arranging order of ink layers in the ink ribbon 33. Thus, if there is no need of taking account of the influence of the transfer operation for the fusible ink on the invisible ink, the transfer operation is simplified advantageously.

Without being limited to the above-mentioned structure and procedure only, needless to say, the present invention may be modified without departing from the scope of the invention.

For instance, the arranging order of respective ink areas in the ink film 33 is not limited to that of the above-mentioned embodiments. Irrespective of the arranging order, the controller 6 judges the kind of respective ink areas and controls the card manufacturing apparatus 60 so as to at least pile up the sublimation ink on a designated area (the first transfer area) on the intermediate-transfer film 11 thereby to form the sublimation-ink image 18 in the same area and also form the invisible-ink image 20 in a different area (the second transfer area).

Figure 15A:
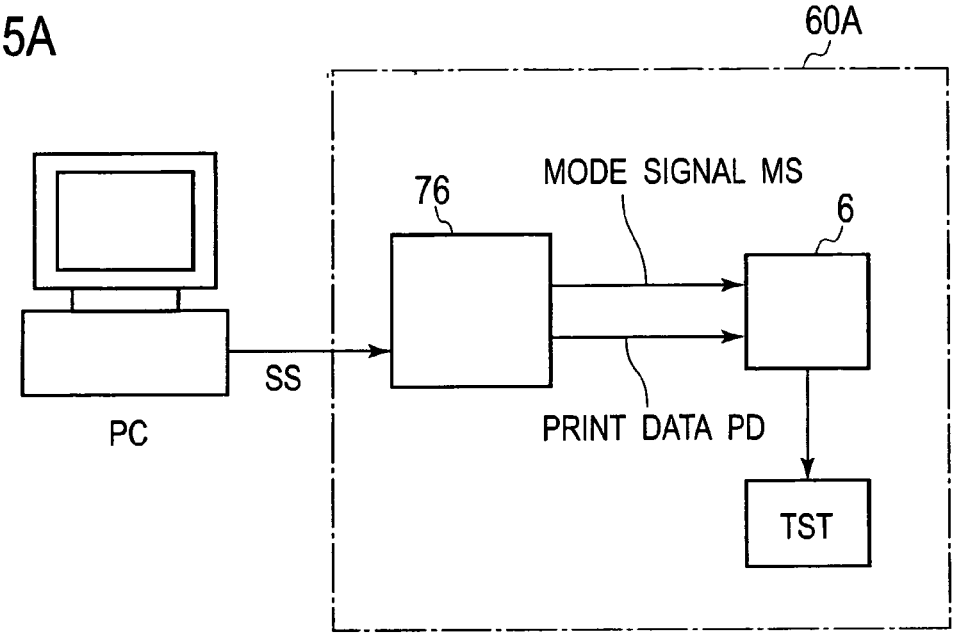
FIGS. 15A and 15B are block diagrams explaining modifications of the re-transfer printing machine in the embodiment of the present invention.

In a modification of the constitution of FIG. 12, as shown in FIG. 15A, the data processor 76 of a card manufacturing apparatus 60A may be controlled by an outside personal computer (PC). Then, from the personal computer, control signals SS are transmitted to the data processor 76.

Figure 15B:
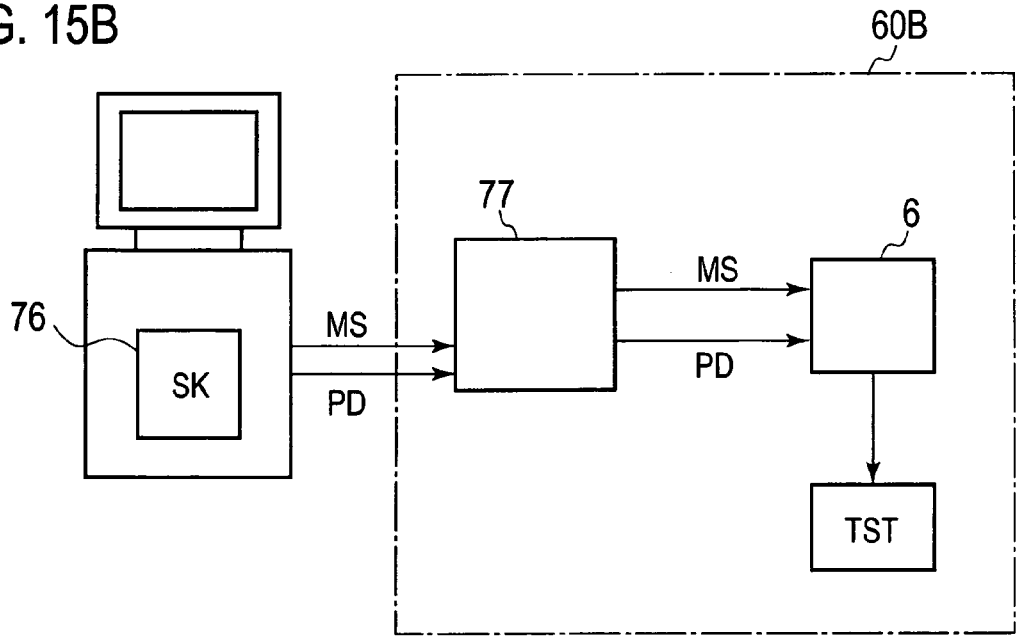

In a further modification, as shown in FIG. 15B, a card manufacturing apparatus 60B may be provided with an input interface 77 while shifting the data processor 76 to an outside processing instrument 76SK, such as personal computer. In operation, the processing instrument 76SK sets the transfer/re-transfer mode in accordance with a program designing the print layout and judging the above-mentioned overlapping, while the card manufacturing apparatus 60B carries out the transfer/re-transfer operations based on the transfer/re-transfer mode signal MS and the print data PD outputted from the processing instrument 76SK.

In addition, the manufacturer's serial number may be stored in the memory part 76-4 at the stage of manufacturing the apparatus. Alternatively, the same number may be stored by a service person later.

Regarding the inherent information to be stored in the memory part 76-4, as mentioned above, it is desired that latest information is written (added) in accordance with the history of trouble-shooting or maintenance. In this view, the printing apparatus may be provided with communication means through which the latest information can be introduced to the memory part.

Finally, it will be understood by those skilled in the art that the foregoing descriptions are nothing but some embodiments and modifications of the disclosed optical system and projection display device and therefore, various changes and modifications may be made within the scope of claims.

What is claimed is:

1. A re-transfer printing machine comprising:

an ink film having a sublimation-ink area of at least one sublimation ink and an invisible-ink area of an invisible ink;

an intermediate-transfer film having a protecting layer and an ink receptor layer laminated on the protecting layer to enable the sublimation ink and the invisible ink to be received therein;

the ink receptor layer having a plurality of transfer areas corresponding to the area of an object to be printed;

a transfer mechanism for transferring the sublimation ink and the invisible ink to the plurality of transfer areas segmentalized in the ink receptor layer thereby to form a sublimation-ink image of the sublimation ink and an invisible-ink image of the invisible ink in the ink receptor layer, based on a print image for the object to be printed;

a re-transfer mechanism for re-transferring the sublimation-ink image and the invisible-ink image to the object thereby to form the print image thereon;

a controller for controlling respective operations of the transfer mechanism and the re-transfer mechanism; and an overlap detecting unit connected to the controller to detect whether the print image for the object contains an overlapping between the sublimation-ink image and the invisible-ink image or not, wherein when the overlap detecting unit detects that the print image contains the overlapping, the controller allows the transfer mechanism to transfer the sublimation-ink image and the invisible-ink image to different transfer areas in the receptor layer, and when the overlap detecting unit detects that the print image does not contain the overlapping, the controller allows the transfer mechanism to transfer both the sublimation-ink image and the invisible-ink image to a same transfer area in the receptor layer.

2. The re-transfer printing machine of claim 1, wherein the ink film further includes a fusible-ink area of a fusible ink, the transfer mechanism further transfers the fusible ink to the plurality of areas segmentalized in the ink receptor layer thereby to form a fusible-ink image in addition to the sublimation-ink image and the invisible-ink image, the overlap detecting unit further detects whether the print image for the object contains an overlapping between the fusible-ink image and the invisible-ink image or not, the controller controls the operation of the transfer mechanism so that a transfer order of the fusible ink and the invisible ink to the intermediate-transfer film changes corresponding to a detection result of the overlap detecting unit with respect to the overlapping between the fusible-ink image and the invisible-ink image.

3. The re-transfer printing machine of claim 1, wherein the invisible ink is an ultraviolet-emitting-ink, and the protecting layer of the intermediate-transfer film is adapted so as to suppress a transmission of light radiated from the invisible-ink image thereby to protect the sublimation-ink image from the light.

4. The re-transfer printing machine of claim 3, wherein the protecting layer of the intermediate-transfer film is made from resinous material mixed with ultraviolet absorbent or ultraviolet-diffusion material.

5. The re-transfer printing machine of claim 1, wherein the invisible-ink image to be printed in the invisible ink contains information inherent to the re-transfer printing machine.

6. The re-transfer printing machine of claim 5, wherein the information inherent to the re-transfer printing machine comprises either a manufacturer's serial number thereof or a media access control (MAC) address for enabling the re-transfer printing machine to be connected to a network.

7. A re-transfer printing method using an ink film having a sublimation-ink area of at least one sublimation ink and an invisible-ink area of an invisible ink and an intermediate-transfer film having a protecting layer and an ink receptor layer laminated on the protecting layer to enable the sublimation ink and the invisible ink to be received therein, the ink receptor layer having a plurality of transfer areas corresponding to the area of an object to be printed, the method comprising the steps of:

detecting whether a print image for the object to be printed contains an overlapping between a sublimation-ink image printed in the sublimation ink and an invisible-ink image printed in the invisible ink or not;

transferring the sublimation ink and the invisible ink to the plurality of transfer area segmentalized in the ink receptor layer thereby to form a sublimation-ink image and the invisible-ink image of the invisible ink in the ink receptor layer, based on the print image for the object to be printed; and re-transferring the sublimation-ink image and the invisible-ink image to the object thereby to form the print image thereon, wherein when it is detected at the detecting step that the print image contains the overlapping, the transferring step includes a step of transferring the sublimation-ink image and the invisible-ink image to different transfer areas in the receptor layer in a longitudinal direction thereof, and when it is detected at the detecting step that the print image does not contain the overlapping, the transferring step includes a step of transferring both the sublimation-ink image and the invisible-ink image to a same transfer area in the receptor layer.

8. The re-transfer printing method of claim 7, wherein the ink film further includes a fusible-ink area of a fusible ink, and the transferring step further includes a step of transferring the fusible ink to the plurality of areas segmentalized in the ink receptor layer thereby to form a fusible-ink image in addition to the sublimation-ink image and the invisible-ink image.

9. The re-transfer printing method of claim 8, further comprising a step of detecting whether the print image for the object contains an overlapping between the fusible-ink image and the invisible-ink image or not, wherein the transferring step includes a step of changing a transfer order of the fusible ink and the invisible ink to the intermediate-transfer film changes corresponding to a detection result at the detecting step about whether the print image for the object contains the overlapping between the fusible-ink image and the invisible-ink image.

10. The re-transfer printing method of claim 7, wherein the invisible ink is an ultraviolet-emitting-ink, and the protecting layer of the intermediate-transfer film is adapted so as to suppress a transmission of light radiated from the invisible-ink image thereby to protect the sublimation-ink image from the light.

11. The re-transfer printing method of claim 10, wherein the protecting layer of the intermediate-transfer film is made from resinous material mixed with ultraviolet absorbent or ultraviolet-diffusion material.

12. The re-transfer printing method of claim 7, wherein the invisible-ink image to be printed in the invisible ink contains information inherent to a re-transfer printing machine carrying out the transferring and re-transferring steps in accordance with the re-transfer printing method.

13. The re-transfer printing method of claim 12, wherein the information inherent to the re-transfer printing machine comprises either a manufacturer's serial number thereof or a media access control (MAC) address for enabling the re-transfer printing machine to be connected to a network.

* * * * *